US006105532A

United States Patent [19]

Eilert

[11] Patent Number: 6,105,532

[45] Date of Patent: Aug. 22, 2000

[54] RIB, RIGID-HULL INFLATABLE BOAT WITH TRANSOM SPACER STRUTS PERMITTING FLEXURE AND MOVEMENT

[75] Inventor: John R. Eilert, Fond du Lac, Wis.

[73] Assignee: Brunswick Corporation, Lake Forest, Ill.

[21] Appl. No.: 09/469,074

[22] Filed: Dec. 21, 1999

Related U.S. Application Data

[62] Division of application No. 09/024,725, Feb. 17, 1998, Pat. No. 6,024,042.

[51] Int. Cl.[7] ..... B63B 3/00

[52] U.S. Cl. ..... 114/355; 114/345; 114/357

[58] Field of Search ..... 114/345, 355–357, 114/65 R, 78

[56] References Cited

U.S. PATENT DOCUMENTS 3,174,166 3/1965 Ehrenberg et al. ..... 114/357

3,176,055 3/1965 Loos ..... 114/357

5,807,152 9/1998 Wojcik ..... 114/357

*Primary Examiner*—Ed Swinehart

*Attorney, Agent, or Firm*—Andrus, Sceales, Starke & Sawall

[57] ABSTRACT

A RIB (22), rigid-hull inflatable boat, includes an inflatable tube (24) having a general U shape with a forward end (26) at the bight of the U and trailing sides (28, 30) extending rearwardly therefrom along the legs of the U, and a molded plastic hull (32) within the tube and attached thereto. The hull has a lower surface (42), an upwardly facing deck (44), a transom (38), and a drain (40) through the transom. The deck has drainage channels (48, 54, 62, 70, 72) forming gutters channeling water to the drain. A removable floor insert (92) is detachably mounted to the deck and covers the drainage channels. Transom construction (120, 122) permits flexure.

4 Claims, 4 Drawing Sheets

FIG. 5
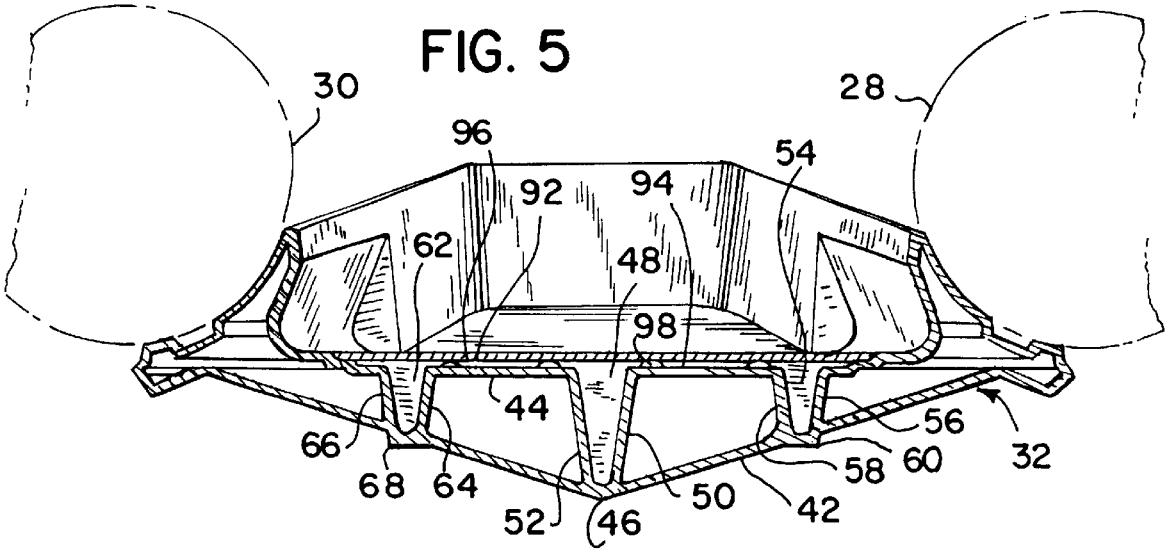
FIG. 6
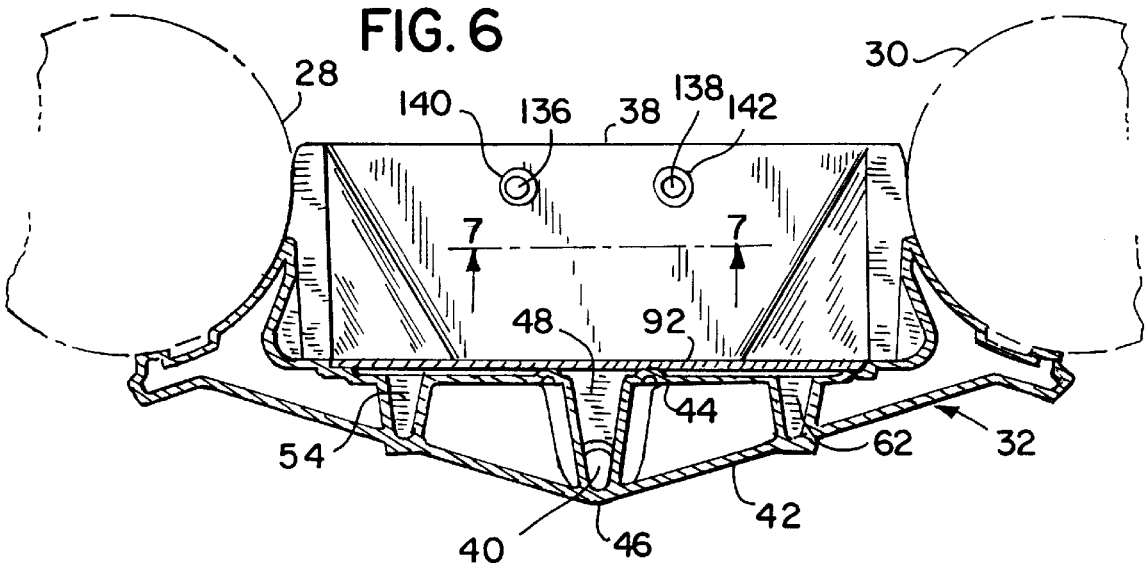
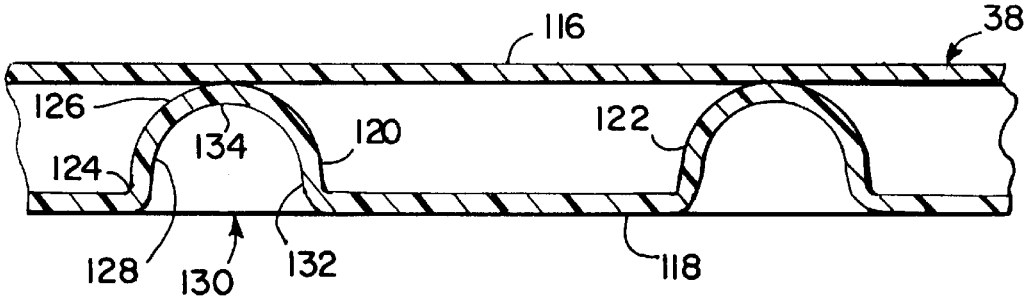
FIG. 7

RIB, RIGID-HULL INFLATABLE BOAT WITH TRANSOM SPACER STRUTS PERMITTING FLEXURE AND MOVEMENT

CROSS REFERENCE TO RELATED APPLICATION

This application is a division of U.S. application Ser. No. 09/024,725, filed Feb. 17, 1998 now U.S. Pat. No. 6,024,042.

BACKGROUND AND SUMMARY

The invention relates to RIBs, rigid-hull inflatable boats, and more particularly to improvements in deck drainage and construction.

The present invention arose during continuing development efforts relating to the subject matter of U.S. Pat. No. 5,522,338, incorporated herein by reference.

A RIB, rigid-hull inflatable boat, includes an inflatable tube having a general U-shape with a forward end at the bight of the U and trailing sides extending rearwardly therefrom along the legs of the U. A molded plastic hull, typically rotationally molded, is nested within the tube and attached thereto. The hull has right and left sides extending along the tube, a transom extending between the right and left sides for mounting an outboard motor, and a drain extending through the transom. The hull has a lower surface and an upwardly facing deck spanning between the right and left sides for supporting the occupants.

In one aspect of the present invention, a gutter drainage system is provided in the deck for channeling water to the drain. In another aspect, a deck construction is provided for mounting a removable floor insert. In other aspect, improved hull constructional structure is provided, including transom reinforcement permitting flexure. Other aspects will be apparent in view of the following detailed description.

BRIEF DESCRIPTION OF THE DRAWINGS

FIG. 5 is a sectional view taken along line 5—5 of FIG. 3.

FIG. 6 is a sectional view taken along line 6—6 of FIG. 3.

FIG. 7 is a sectional view taken along line 7—7 of FIG. 6.

DETAILED DESCRIPTION

Figure 1:
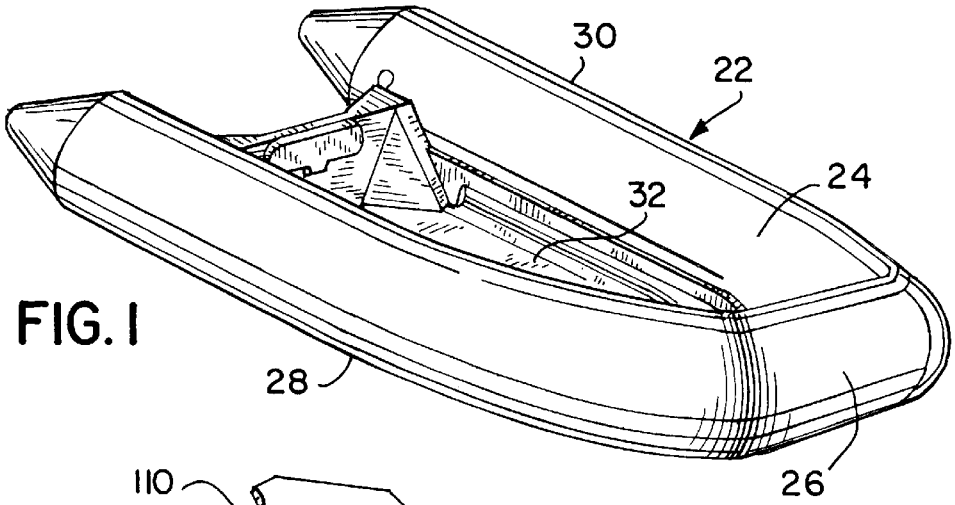
FIG. 1 is a perspective view of a RIB, rigid-hull inflatable boat, constructed in accordance with the invention.
Figure 2:
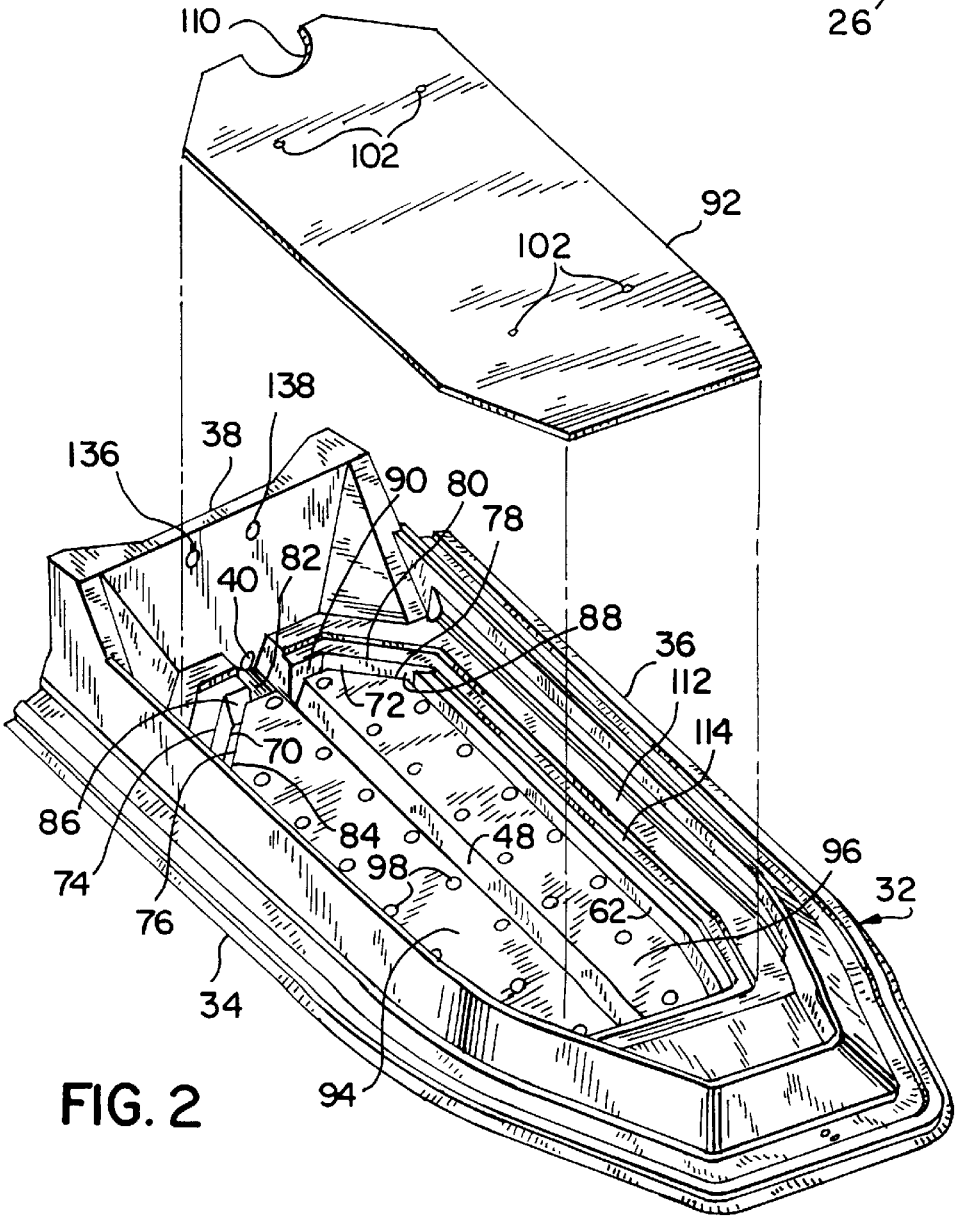
FIG. 2 is a perspective view of a portion of the structure of FIG. 1.
Figure 3:
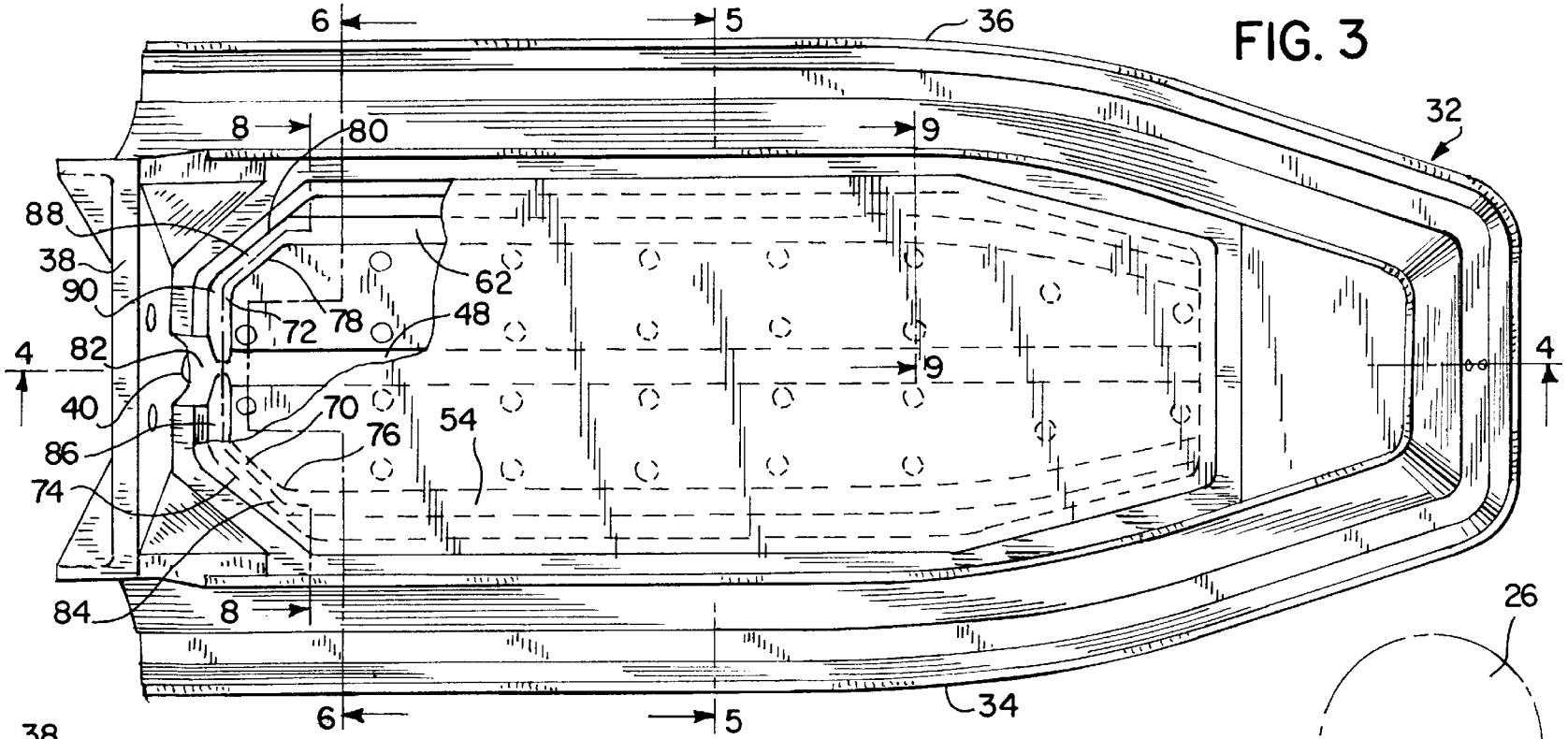
FIG. 3 is a top view partially cut away of the structure of FIG. 2.
Figure 4:
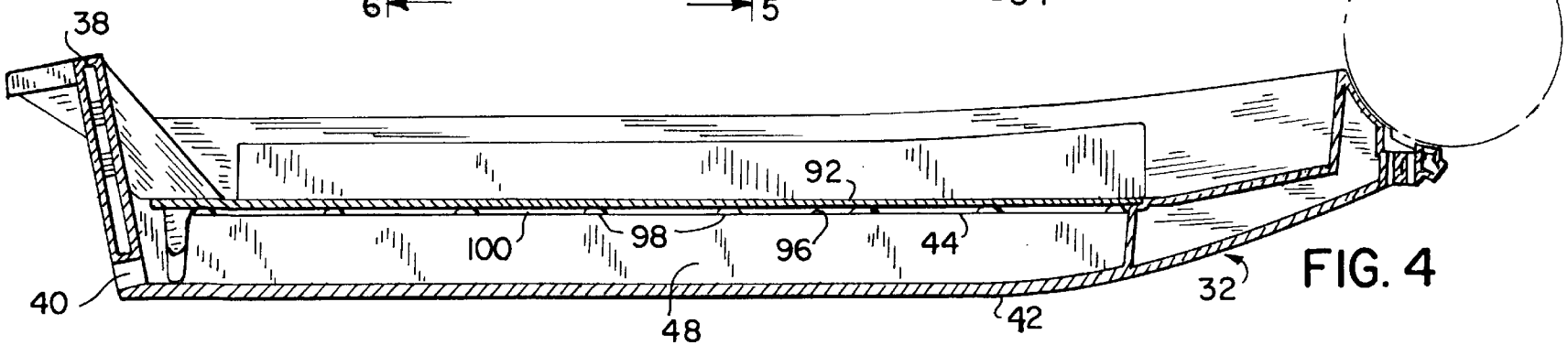
FIG. 4 is a sectional view taken along line 4—4 of FIG. 3.
Figure 10:
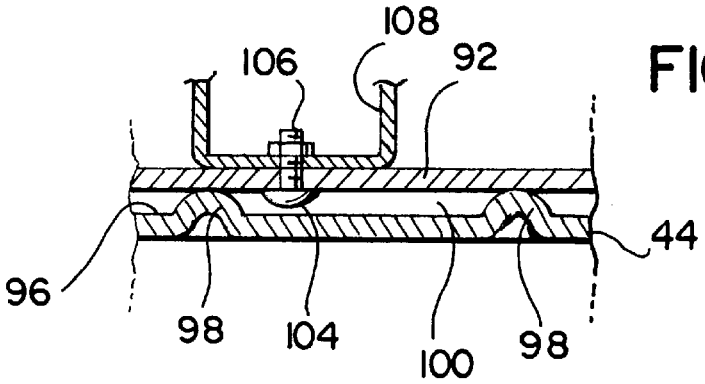
FIG. 10 is a view similar to FIG. 9 and shows a further embodiment.

FIG. 1 shows a RIB 22, rigid-hull inflatable boat. An inflatable tube 24 has a general U-shape with a forward end 26 at the bight of the U and trailing sides 28 and 30 extending rearwardly therefrom along the legs of the U. A molded plastic hull 32, FIGS. 1 and 2, is nested within the tube and attached thereto, as shown in incorporated U.S. Pat. No. 5,522,338. Hull 32 is preferably a unitary rotationally molded member, preferably polyethylene. Rotational molding, or roto-molding, is known in the art, and for which further reference may be had to the incorporated '338 patent. Hull 32 is detachably secured to tube 24 by a mechanical locking device as shown at 132 in FIG. 6 of the incorporated '338 patent and particularly described therein beginning at column 4, line 33, and to which further reference may be had by incorporation. Hull 32 has right and left sides 34 and 36, FIGS. 2 and 3, extending along the tube, a transom 38 extending between the right and left sides, and a drain 40 extending through the transom. It is preferred that the drain have a one-way valve such as shown in FIGS. 10 and 11 of the incorporated '338 patent. Hull 32 has a lower surface 42, FIG. 5, and an upwardly facing deck 44 spanning between the right and left sides. Lower surface 42 is V-shape in lateral cross section, and drain 40, FIG. 6, is aligned with the lower apex 46 of the V at the bottom of the transom.

Upwardly facing deck 44 has a plurality of recessed channels forming a gutter matrix which channels water to drain 40. A first central longitudinal channel 48, FIGS. 2–6, extends longitudinally fore to aft along the deck and is formed by a pair of sidewalls 50 and 52 extending between deck 44 and lower surface 42 at the lower apex 46 of the V. A second rightward longitudinal channel 54 extends longitudinally fore to aft along the deck and is spaced rightwardly of central channel 48 and is formed by a pair of sidewalls 56 and 58 extending between deck 44 and lower surface 42 at a right strake 60. A third leftward longitudinal channel 62 extends longitudinally fore to aft along the deck and is spaced leftwardly of central channel 48 and is formed by a pair of sidewalls 64 and 66 extending between deck 44 and lower surface 42 at a left strake 68.

The deck includes a fourth recessed channel 70, FIG. 2, adjacent transom 38 and extending laterally from the aft end of right channel 54 to the aft end of central channel 48, such that channels 54 and 70 form a gutter channeling water longitudinally rearwardly along right channel 54 then laterally through channel 70 to drain 40. The deck includes a fifth recessed channel 72 adjacent the transom and extending laterally from the aft end of left channel 62 to the aft end of central channel 48, such that channels 62 and 72 form a gutter channeling water longitudinally rearwardly along channel 62 then laterally through channel 72 to drain 40. Channel 70 is formed by a pair of sidewalls 74 and 76 extending between deck 44 and lower surface 42. Channel 70 has a depth which increases as the channel extends laterally from right channel 54 toward central channel 48 to enable water to run laterally downhill in channel 70. Channel 72 is formed by a pair of sidewalls 78 and 80 extending between deck 44 and lower surface 42. Channel 72 has a depth which increases as the channel extends laterally from left channel 62 towards central channel 48 to enable water to run laterally downhill in channel 72. Channels 70 and 72 meet at a central junction well 82 at the aft end of central channel 48 immediately forward of drain 40.

The aft end of central channel 48 is aft of the aft end of each of right and left channels 54 and 62. Channel 70 includes a first section 84 extending rearwardly and laterally from the aft end of right channel 54 and obliquely relative to the longitudinal extension of channel 54. Channel 70 includes a second section 86 extending laterally from first section 84 and perpendicularly relative to the longitudinal extension of central channel 48. Channel 72 includes a first section 88 extending rearwardly and laterally from the aft end of left channel 62 and obliquely relative to the longitudinal extension of channel 62. Channel 72 includes a second section 90 extending laterally from first section 88 and perpendicularly relative to the longitudinal extension of central channel 48. Second section 86 of channel 70 is laterally colinear with second section 90 of channel 72.

A removable floor insert 92, FIG. 2, is detachably mounted to deck 44 and covers the channels. Deck 44 has an upwardly facing surface 94 between channels 48 and 54, and an upwardly facing surface 96 between channels 48 and 62. The deck has a plurality of mounting pads 98 on surfaces 94, 96 supporting floor insert 92 and providing clearance 100, FIG. 9, of the floor insert, above surfaces 94, 96. Insert 92 preferably has a plurality of apertures such as 102, FIG. 2, therethrough for receiving a respective screw or the like (not shown) screwed into a respective mounting pad, which latter may have a threaded insert molded in place for receiving such screw. Clearance 100 is sufficient to enable debris to flush therethrough and into the deck channels, and to enable the space between floor insert 92 and upwardly facing surfaces 94 and 96 of the deck to dry out between flushings. Clearance 100 is also sufficient to accommodate the height of a bolt head 104, FIG. 10, of a bolt 106 extending upwardly through floor insert 92 to enable attachment of an item 108 to floor insert 92. Floor insert 92 has a cut-out 110, FIG. 2, at the aft end thereof and spaced immediately forward of and above drain 40.

Figure 9:
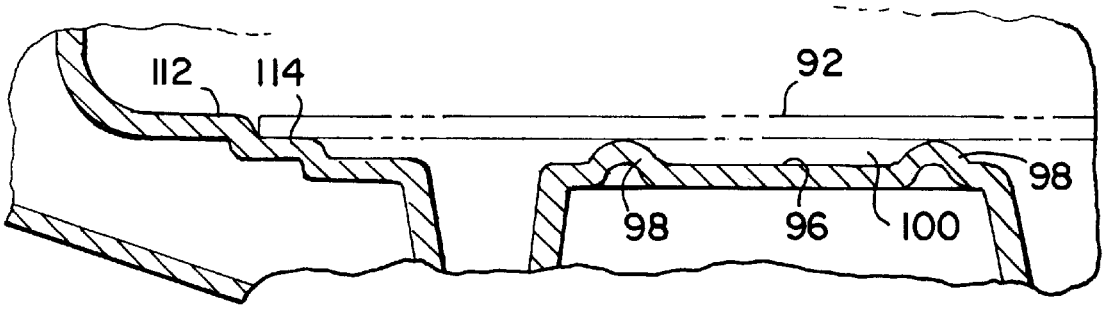
FIG. 9 is a sectional view taken along line 9—9 of FIG. 3.

Deck 44 has a first perimeteral surface 112, FIGS. 2 and 9, facing upwardly and extending along a first perimeter around the channels. The deck has a second perimeteral surface 114 facing upwardly and extending along a second perimeter around the channels. The noted second perimeter is within the noted first perimeter. Floor insert 92 is supported at its perimeter on surface 114. The central portions of floor insert 92 are supported on surfaces 94 and 96 at pads 98. Surface 114 is recessed below surface 112 by the thickness of floor insert 92. Surface 114 is coplanar with the tops of mounting pads 98. Upwardly facing surfaces 94 and 96 are recessed below surface 114 by the height of mounting pads 98.

Figure 8:
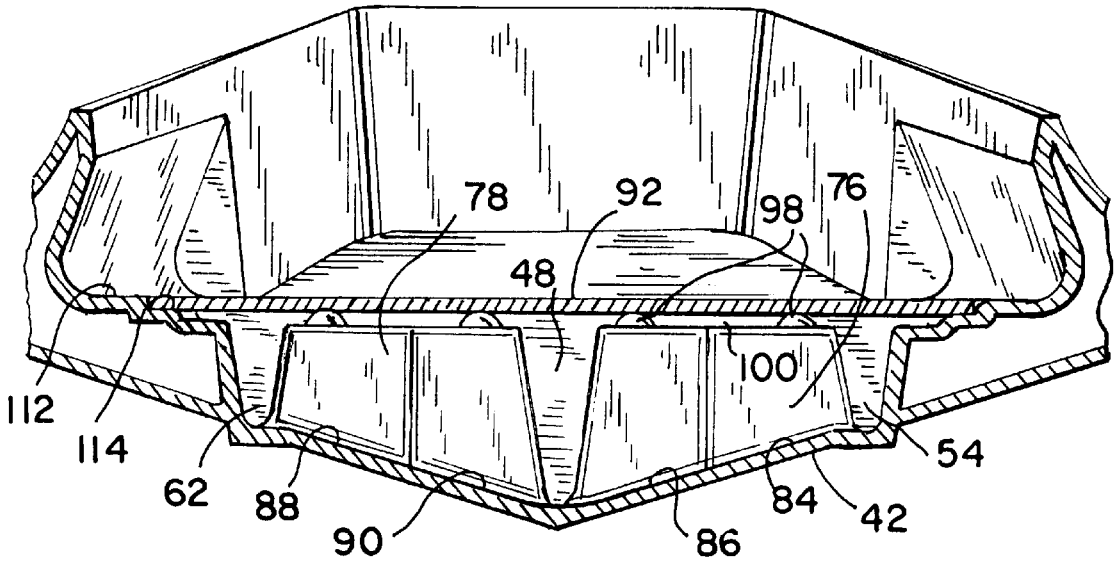
FIG. 8 is a sectional view taken along line 8—8 of FIG. 3.

Transom 38 has spaced front and rear walls 116 and 118, and a plurality of spacer struts 120, 122 extending between the walls to maintain spacing therebetween. The spacer struts have one end 124 integral with rear wall 118, and have another end 126 nonintegral with front wall 116 and rubbing thereagainst upon flexure of transom 38, to permit such flexure and slight relative movement between end 126 and wall 116 but still maintaining the spacing between walls 118 and 116. The molded plastic transom 38 flexes due to the load of the outboard motor thereon and due to propulsion drive thrust. The spacer struts are provided by sidewalls 128 of blind holes 130 having an open end 132 at rear wall 118, and having a closed end 134 at front wall 116. Each spacer slot is a hemisphere. Closed end 134 of blind hole 130 rubs against front wall 116 permitting the noted flexure of the transom without breaking or cracking an otherwise integral connection of spacer strut end 126 to wall 116. Front and rear walls 116 and 118 have through-holes 136 and 138, FIGS. 2 and 6, receiving anti-compression sleeves or spacers 140 and 142 supporting clamping pressure of a motor attachment device, for example as shown in the incorporated '338 patent, including FIG. 8.

It is recognized that various equivalents, alternatives and modifications are possible within the scope of the appended claims.

What is claimed is:

1. A RIB, rigid-hull inflatable boat, comprising an inflatable tube having a general U shape with a forward end at the bight of the U and trailing sides extending rearwardly therefrom along the legs of the U, a molded plastic hull nested within said tube and attached thereto, said hull having right and left sides extending along said tube, a transom extending between said right and left sides and having spaced front and rear walls and a plurality of spacer struts extending between said walls to maintain spacing therebetween, said struts having one end integral with one of said walls and having another end nonintegral with the other of said walls and rubbing thereagainst upon flexure of said transom to permit said flexure and relative movement between said other end of said spacer strut and said other wall but still maintaining said spacing between said front and rear walls.

2. The RIB according to claim 1 wherein said spacer struts are sidewalls of blind holes having an open end at said one wall and having a closed end at said other wall.

3. The RIB according to claim 2 wherein each of said spacer struts is hemispherical.

4. The RIB according to claim 2 wherein said closed end of said blind hole rubs against said other wall, permitting said flexure.

* * * * *